US009516911B2

(12) United States Patent
Happel et al.

(10) Patent No.: US 9,516,911 B2
(45) Date of Patent: Dec. 13, 2016

(54) HARDHAT ACCESSORY INTERCHANGE SYSTEM

(71) Applicant: Kimberly-Clark Worldwide, Inc., Neenah, WI (US)

(72) Inventors: Michael W. Happel, Cumming, GA (US); Jessica P. Tebbe, Alpharetta, GA (US); Lowell Seal, Reisterstown, MD (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 275 days.

(21) Appl. No.: 14/223,133

(22) Filed: Mar. 24, 2014

(65) Prior Publication Data

US 2015/0264992 A1 Sep. 24, 2015

Related U.S. Application Data

(60) Provisional application No. 61/806,441, filed on Mar. 29, 2013.

(51) Int. Cl.
*A42B 1/24* (2006.01)
*A42B 3/22* (2006.01)

(52) U.S. Cl.
CPC ..... *A42B 3/225* (2013.01); *A42B 3/223* (2013.01)

(58) Field of Classification Search
CPC ..... A42B 3/18; A42B 3/185; A42B 3/221; A42B 3/223; A42B 3/225; A61F 9/06; A61F 9/067; B23K 9/322
USPC ..... 2/422, 424, 8.1, 8.2, 9, 15, 6.5, 6.3, 423,2/6.7; 403/120, 410
See application file for complete search history.

(56) References Cited

U.S. PATENT DOCUMENTS

| | | | | |
|---|---|---|---|---|
| 4,109,320 | A | 8/1978 | Anderson | |
| 4,479,738 | A * | 10/1984 | Kubnick | A42B 3/04 2/10 |
| 5,966,738 | A | 10/1999 | Wang Lee | |
| 6,041,435 | A | 3/2000 | Paulson et al. | |
| 6,264,392 | B1 | 7/2001 | Wise et al. | |
| 6,820,285 | B2 | 11/2004 | Bataille et al. | |
| 6,851,129 | B2 | 2/2005 | Gafforio et al. | |
| 7,594,278 | B2 | 9/2009 | Huh | |
| 8,214,920 | B1 * | 7/2012 | Edgar | A42B 3/225 2/422 |
| 2004/0181856 | A1 | 9/2004 | Oleson | |
| 2004/0199982 | A1 | 10/2004 | Wang-Lee | |
| 2012/0246807 | A1 | 10/2012 | Klotz et al. | |

* cited by examiner

*Primary Examiner* — Nathan Durham
*Assistant Examiner* — Abby Spatz

(57) ABSTRACT

An interchangeable accessory system for hardhats is disclosed which includes two accessory interchange assemblies that permit accessories such as face shields and welding shields to be attached to and removed from a hardhat while the hardhat remains on the head of the user.

8 Claims, 17 Drawing Sheets

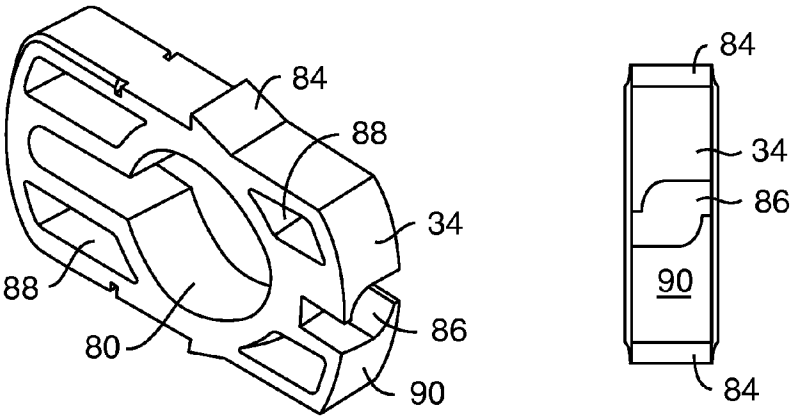
FIG. 20
FIG. 21
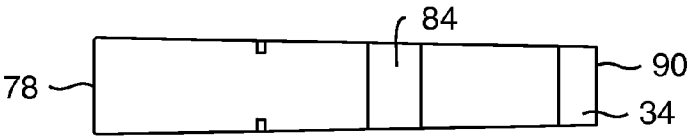
FIG. 22
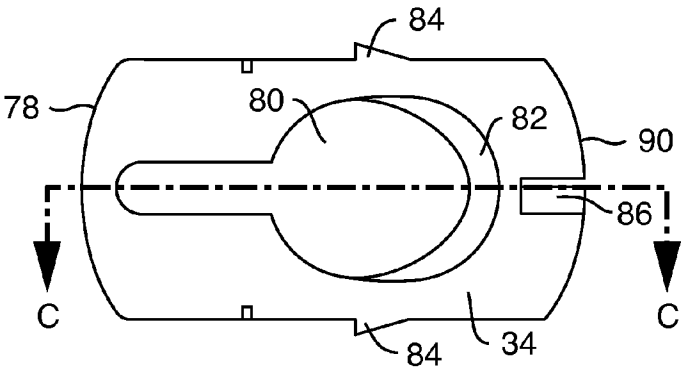
FIG. 23
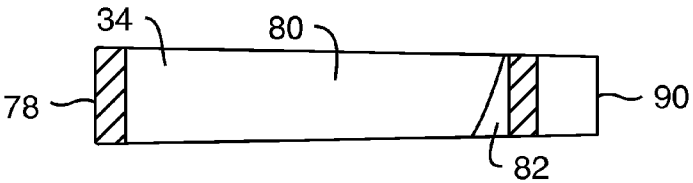
FIG. 24

HARDHAT ACCESSORY INTERCHANGE SYSTEM

This application claims the benefit of priority from U.S. Provisional Application No. 61/806441 filed on Mar. 29, 2013.

FIELD OF THE INVENTION

The present invention relates generally to the field of safety head gear, and more specifically to an interchangeable accessory system for hardhats.

BACKGROUND OF THE INVENTION

Recent safety protocol trends in manufacturing environments mandate that workers such as welders wear their hardhats at all times. During a typical workday, a welder will switch between accessories such as a welding mask and face shield depending on the task at hand. For example, the worker may replace their welding mask with a face shield after they've made a weld and need to grind the seam. Current hardhat accessory attachment systems are not intuitive and easy to use. As a result, the welder may disregard safety procedures by removing their hardhat so they can visually see how to install or remove the welding mask or face shield. As there is no comprehensive and satisfactory solution for switching hardhat accessories, users may also cobble together parts to attach the needed accessory to their hardhat. This could result in ineffective safety protection for workers.

There exists a need for a simple and safe solution that allows welders to easily and quickly interchange accessories such as welding masks, face shields and the like without having to remove their hardhat.

SUMMARY OF THE INVENTION

The present invention is directed to a hardhat accessory interchange system which attaches an accessory such as a welding shield, a face shield or other accessory to a hardhat. The hardhat accessory interchange system of the present invention includes a left hand hardhat accessory interchange assembly and a right hand hardhat accessory interchange assembly. Many different styles of hardhats are manufactured with a slot positioned on each side of the hardhat. The left hand hardhat accessory interchange assembly may be configured to engage the left side slot in the hardhat as well as the right side slot in the hardhat. Similarly, the right hand hardhat accessory interchange assembly may be configured to engage the right side slot in the hardhat as well as the left side slot in the hardhat. This permits a user to wear the hardhat with the bill facing backwards rather than forwards and still use the hardhat accessory interchange system in the correct manner.

With the hardhat accessory interchange system of the present invention, a user may remove an accessory such as a face shield or a welding shield from their hardhat by grasping the right hand hardhat accessory interchange assembly in their right hand and the left hand hardhat accessory interchange assembly in their left hand. The hands of the user are positioned so that each thumb is in contact with a button that extends outwardly from each assembly. The user pushes the button causing the assembly to separate into two portions—an accessory portion and a hardhat portion. The accessory portion remains on the accessory and the hardhat portion of the hardhat accessory interchange assembly remains on the hardhat. This permits the accessory to be easily removed from the hardhat. A different accessory may be attached to the hardhat if the accessory includes an accessory portion of the hardhat accessory interchange mechanism.

The right hand hardhat accessory interchange assembly will be described, however it is to be understood that the left hand hardhat accessory interchange assembly includes identical or similar parts which permit the left hand hardhat accessory interchange assembly to function on the opposite side of the hardhat.

The right hand hardhat accessory interchange assembly includes a right blade that is adapted to engage the right slot in the hardhat. The right blade 31 is shown in more detail in FIGS. 13-19. A button is partially retained within the right blade, a spring being positioned within the right blade to bias the button outward. When the button is pushed inward the accessory portion is released from the hardhat portion.

The right hand hardhat accessory interchange assembly also includes a right latch having a first end and a second end. The second end of the right latch is joined to the accessory by a keeper. The keeper is positioned on the outside of the accessory and connects through the accessory to the right latch which is positioned on the inside of the accessory. Said another way, the outward facing side of the right latch is positioned adjacent to the inner side of the accessory and the keeper is adjacent to the outer side of the accessory. The right latch and the keeper may be connected through an aperture in the accessory via a threaded fastening system or other connection system.

An aperture is formed in the first end of the right latch. A knob attachment mechanism extends through the aperture in the right latch to attach a knob to the outward facing side of the right latch. The knob attachment mechanism is also adapted to engage the right blade. Preferably the knob attachment mechanism includes a threaded fastener to engage the knob and a disk having an upper surface and a lower surface. In some embodiments, the threaded fastener may extend from the upper surface of the disk. Similarly, a post may extend from the lower surface of the disk and include features which permit it to rotatably engage the right blade.

BRIEF DESCRIPTION OF THE DRAWINGS

FIG. 20 is a perspective view of an embodiment of the button useful in the present invention;

FIG. 21 is an end view of the button depicted in FIG. 20;

FIG. 22 is a top view of the button depicted in FIG. 20;

FIG. 23 is an opposite side view of the button depicted in FIG. 20;

FIG. 24 is a cross-sectional view of the button depicted in FIG. 23 taken along line C-C;

DETAILED DESCRIPTION

Reference will now be made in detail to embodiments of the invention, one or more examples of which are illustrated in the figures. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

Figure 1:
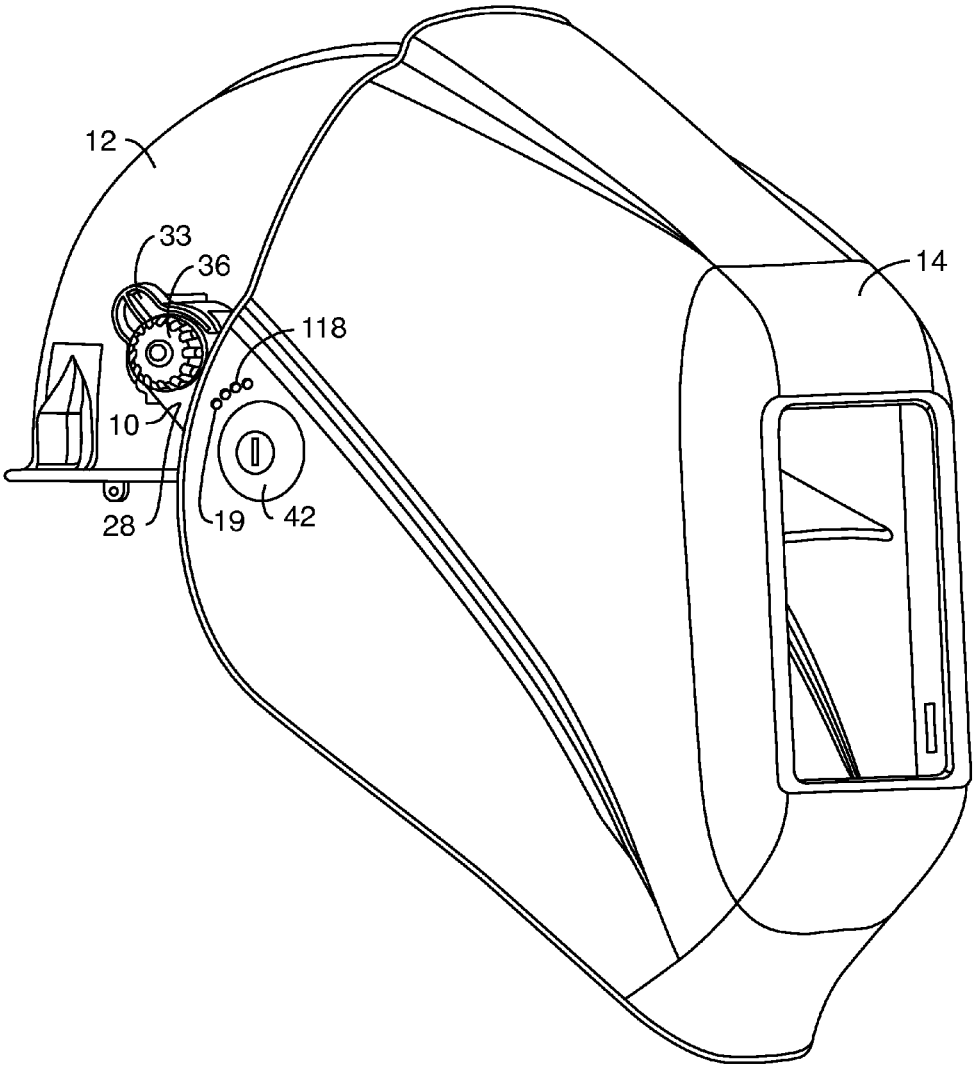
FIG. 1 is a perspective view of a welding shield attached to a hardhat with an embodiment of a hardhat accessory interchange system, the welding shield in the lowered position.
Figure 2:
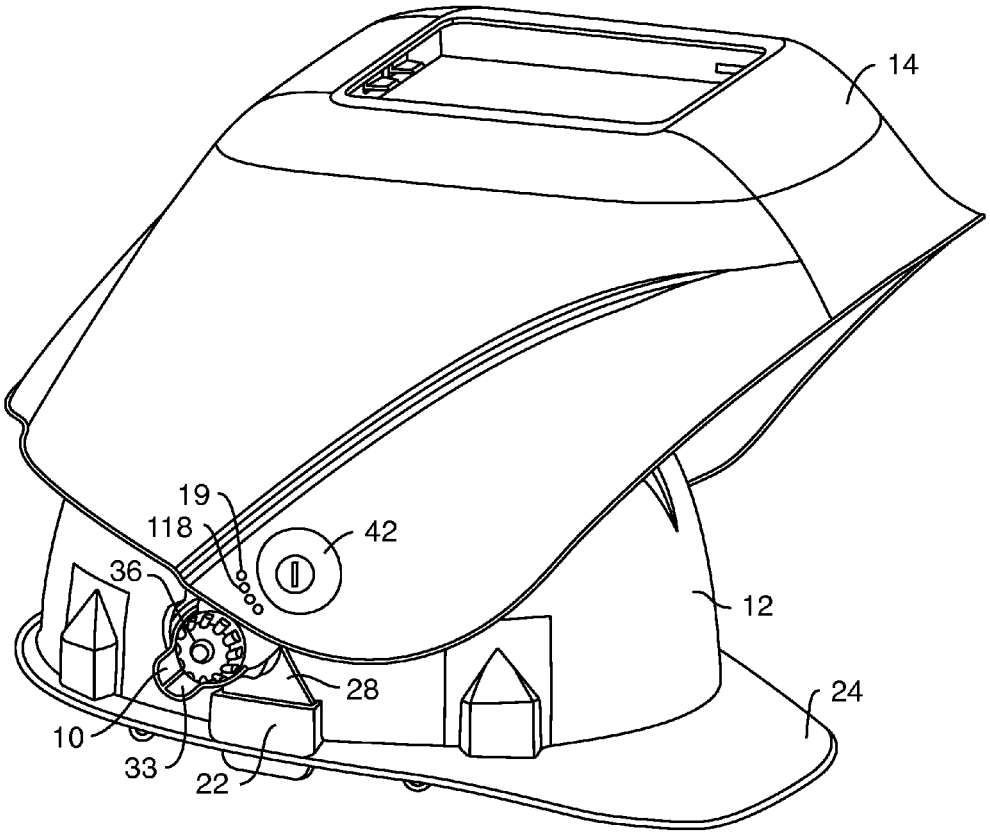
FIG. 2 is a perspective view of a welding shield attached to a hardhat with an embodiment of a hardhat accessory interchange system, the welding shield in the raised position.
Figure 3:
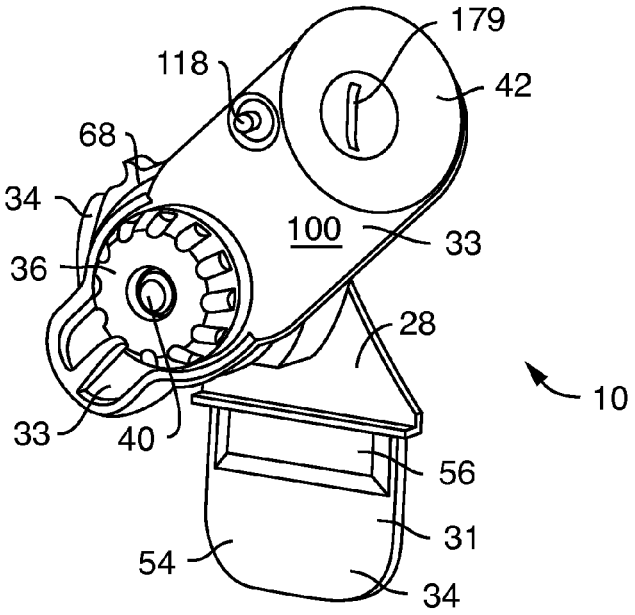
FIG. 3 is a perspective view of the right side of an embodiment of the hardhat accessory interchange system of the present invention.
Figure 4:
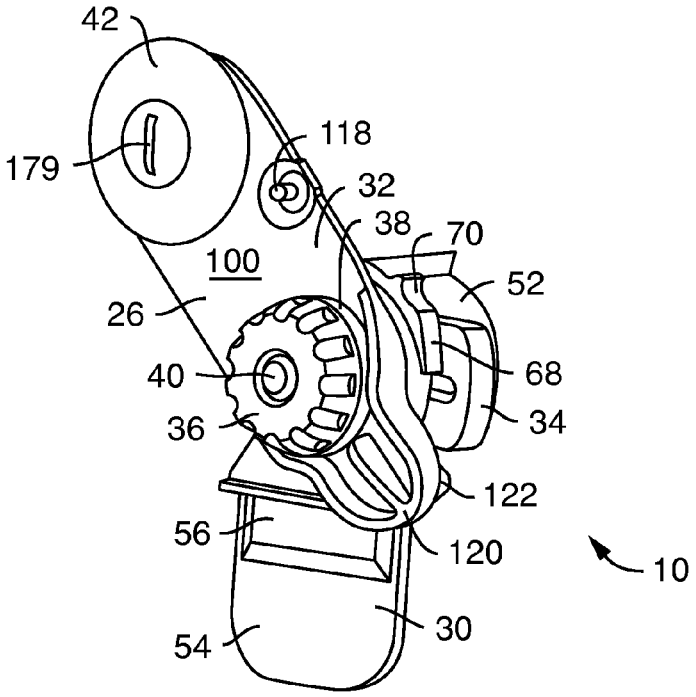
FIG. 4 is a perspective view of the left side of an embodiment of the hardhat accessory interchange system of the present invention.
Figure 45:
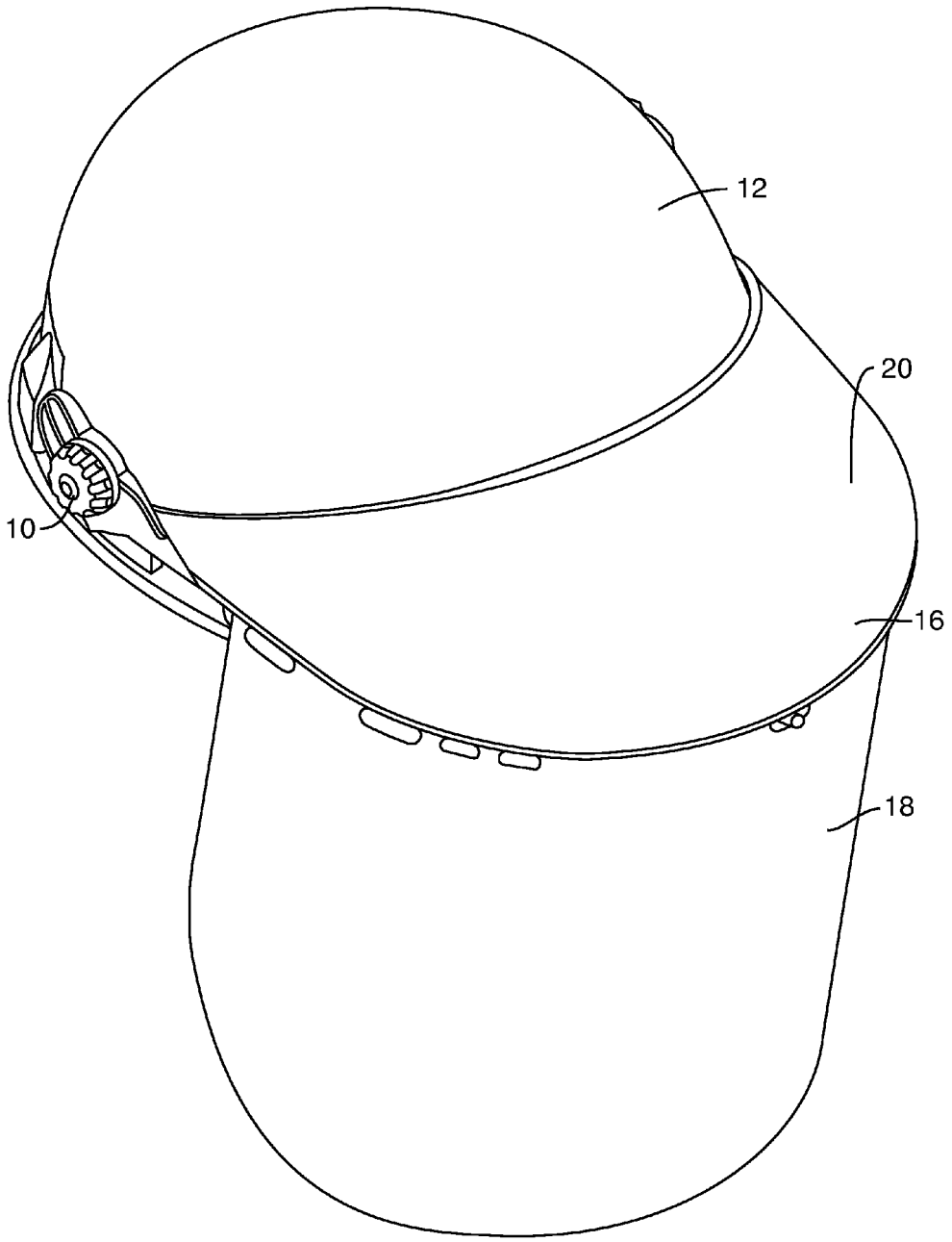
FIG. 45 is a perspective view of a face shield attached to a hardhat with the hardhat accessory interchange system, the shield in the lowered position.
Figure 46:
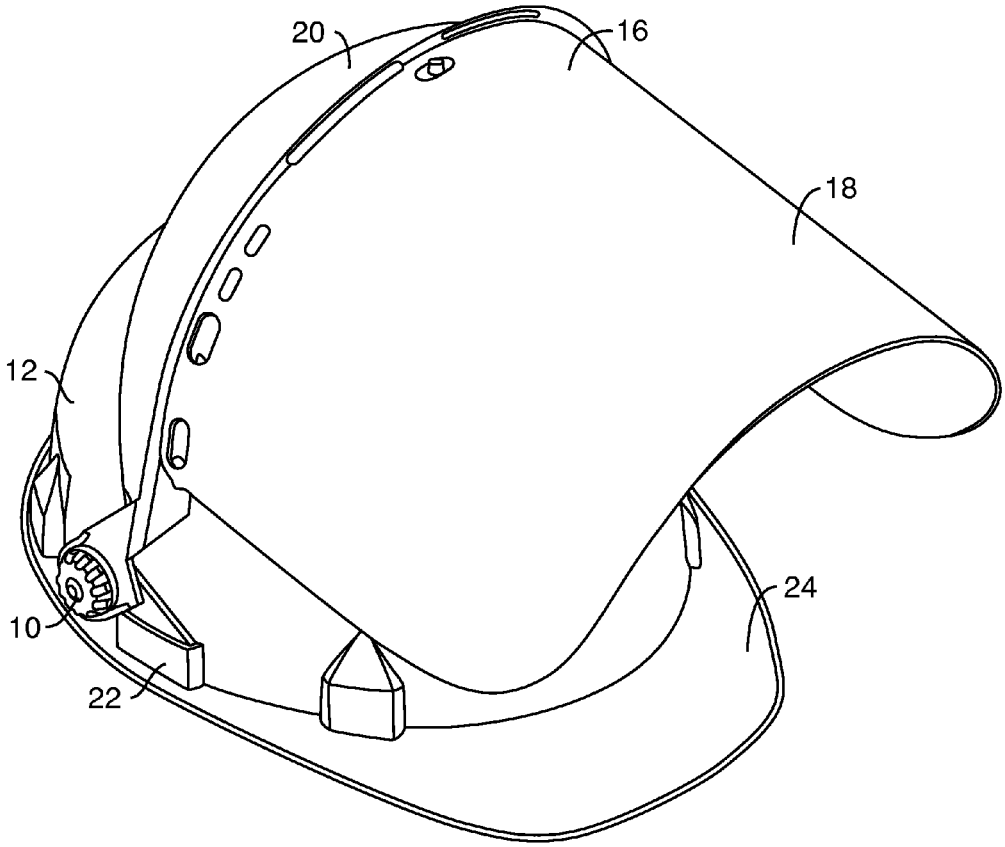
FIG. 46 is a perspective view of the face shield attached to a hardhat with the hardhat accessory interchange system as shown in FIG. 45, the shield in the raised position.
Figure 47:
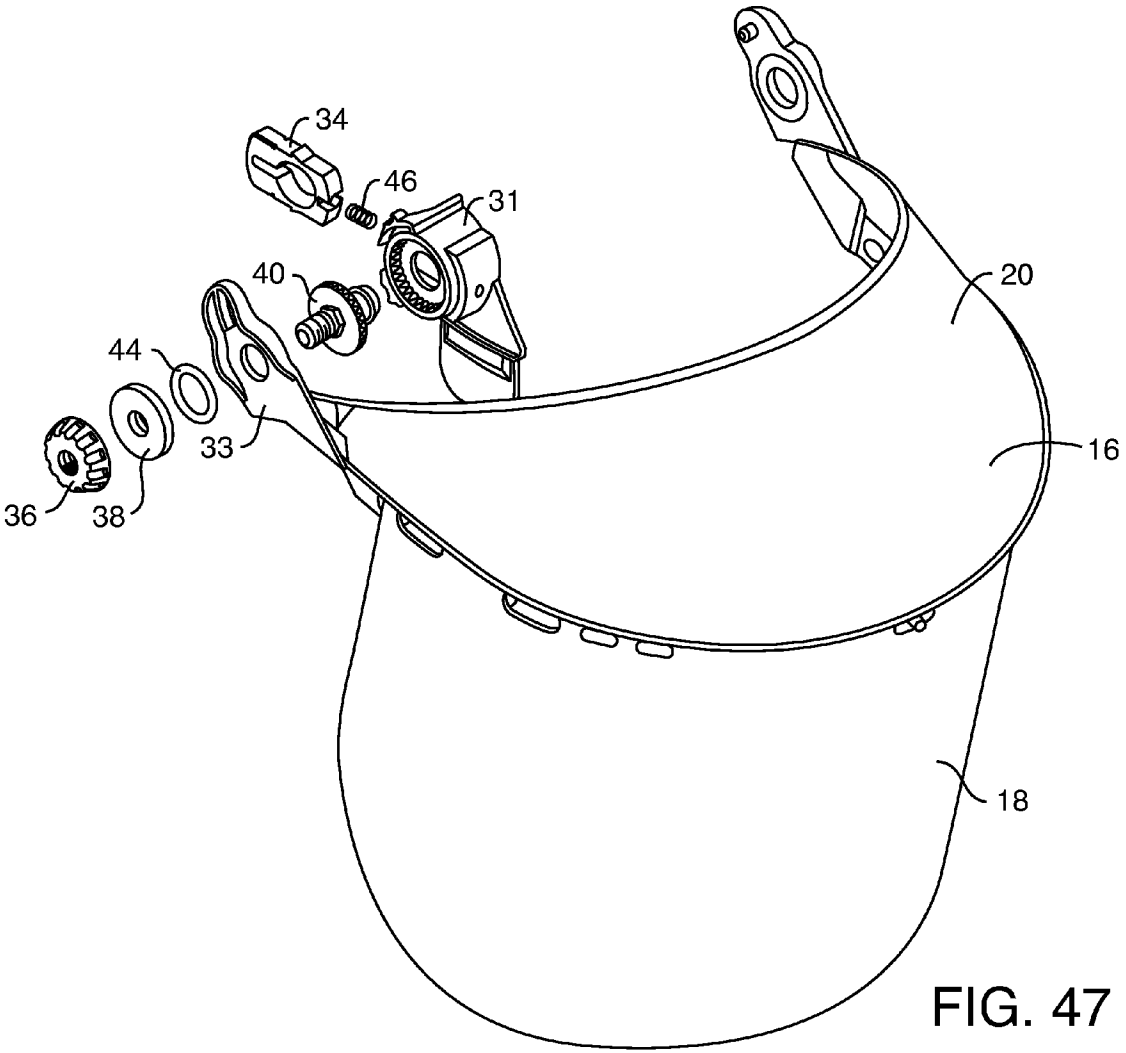
FIG. 47 is an exploded perspective partial view of the face shield, hardhat and hardhat accessory interchange system depicted in FIG. 45.

The present invention is directed to a hardhat accessory interchange system 10 shown in FIGS. 1-5 which is configured to attach an accessory such as a welding shield 14 or face shield assembly 16 to a hardhat 12. FIGS. 1 and 2 show a welding shield 14 which is attached to a hardhat 12 with the hardhat accessory interchange system 10. The hardhat accessory interchange system includes a left hand assembly 26 and a right hand assembly 28 which are shown in FIGS. 3 and 4. FIGS. 45-47 illustrate a face shield assembly 16 attached to a hardhat 12, the face shield assembly 16 including a face shield 18 secured to a headgear assembly 20. The face shield 18 may be secured to the headgear assembly 20 using clips or pins or other suitable fasteners. Various styles and types of face shields and welding shields may be attached to the head gear assembly 20.

Hardhats are available which include a left slot and a right slot 22, such as is shown in FIGS. 2 and 46. Such slots are commonly included in hardhats to enable various accessories to be directly attached to the hardhat. For example, accessories such as face shields, welding shields and hearing protection may be attached directly to such slots in hardhats. Many hardhats also have bills such as bill 24 shown in FIGS. 1 and 2.

In FIGS. 1 and 2, a welding shield 14 is attached to the hardhat 12 and is shown in the 'down' position. The lens which is part of a welding shield is not shown in any figures to enable clear views of features of the present invention. FIG. 2 shows the welding shield 14 after it has been rotated into its 'up' position, enabling a person wearing the hardhat 12 to see without the welding shield 14 obstructing the person's view.

The left and right hardhat accessory interchange assemblies 26 and 28, respectively, are shown in FIGS. 3 and 4 and engage slots 22 which are positioned on the left and right sides, respectively, of the hardhat 12. An individual wearing the hardhat 12 in its regular position with the hardhat bill 24 facing forward would operate the left assembly positioned on the left side of the hardhat 12 with their left hand and the right assembly positioned on the right side of the hardhat 12 with their right hand. Some individuals choose to wear the hardhat 12 with the bill 24 facing backwards. The left and right hardhat accessory interchange assemblies 26 and 28 may be adapted to engage the slots 22 on either side of the hardhat 12 so the individual would still utilize their left hand to operate the left assembly and their right hand to operate the right assembly. Each hardhat accessory interchange assembly 26 and 28 includes an outward facing side and a hardhat facing side.

As seen in FIGS. 1 and 2, least two alignment holes 19 are positioned in the welding shield 14 proximate to the keeper 42. An accessory position adjustment pin 118 which is shown in FIGS. 3 and 4 is part of the hardhat accessory interchange assemblies 26 and 28. The accessory position adjustment pin 118 extends through one of the alignment holes 19 in the accessory as shown in FIGS. 1 and 2. The user may select which alignment hole 19 the accessory adjustment pin 118 should engage to provide the optimum fit for the user.

While some elements of the left and right assemblies 26 and 28, respectively can be interchanged, some elements are the mirror images of each other. Focusing on FIG. 3, the right hand assembly 28 is shown and includes a right blade 31, a right latch 33, a knob 36 and a keeper 42. The accessory adjustment pin 118 is positioned on the outward facing surface 100 of the right latch 33. Turning now to FIG. 4, the left assembly 26 is shown and includes a left blade 30, a left latch 32, a knob 36 and a keeper 42. The alignment pin 118 on the left latch 32 is similarly positioned near a keeper 42. The button 34, first spring arm 68 and indentation 70 can also be seen in FIG. 4. As shown in FIGS. 1-4, each of the left and right assemblies 26 and 28, respectively, includes the keeper 42 which attaches the accessory to the left and right hardhat accessory interchange assemblies 26 and 28. As seen in FIGS. 1 and 2, the keeper 42 is positioned on the exterior of the welding shield 14.

Figure 18:
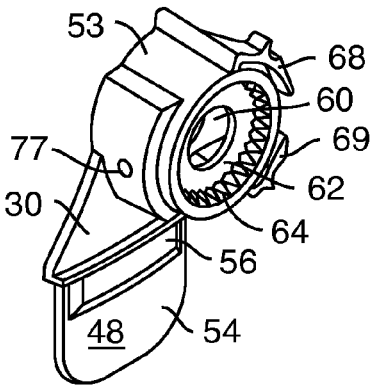
FIG. 18 is a perspective view of an embodiment of the left blade.
Figure 19:
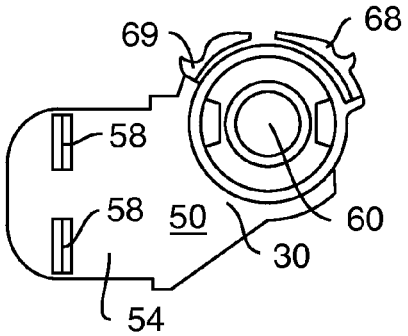
FIG. 19 is a view of the inward or hardhat facing side of the embodiment of the left blade depicted in FIG. 18.

Referring now to FIGS. 3, 5 and 13-17, the right blade 31 will be discussed in detail. The left blade 30 depicted in FIGS. 18 and 19 will include the same features, however the features will be arranged to function on the left rather than the right side of the hardhat.

Figure 14:
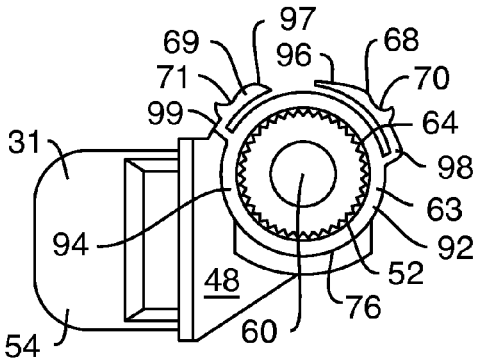
FIG. 14 is a view of the outward facing side of the embodiment of the right blade depicted in FIG. 13.
Figure 15:
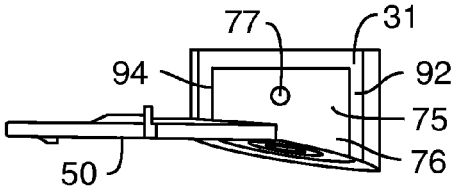
FIG. 15 is a rear view of the embodiment of the right blade depicted in FIG. 13.
Figure 16:
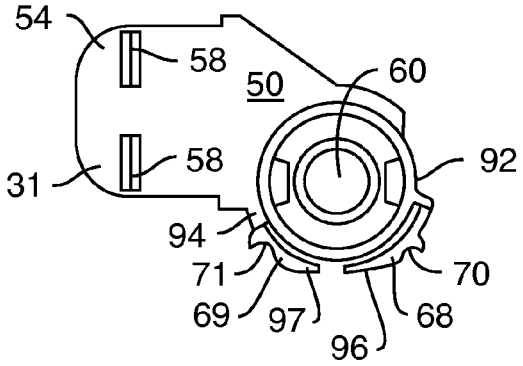
FIG. 16 is a view of the inward or hardhat facing side of the embodiment of the right blade depicted in FIG. 13.
Figure 17:
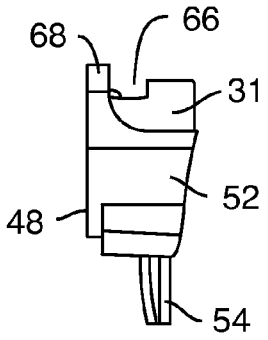
FIG. 17 is a top view of the embodiment of the right blade depicted in FIG. 13.

The right blade 31 includes an outwardly facing side 48 (FIGS. 14 and 17) and a hardhat facing side 50 (FIGS. 15 and 16). A tab 54 extends downwardly and fits within slot 22 on the right side of the hardhat. Select embodiments of the tab 54 may include a wedge and stop 56 positioned near the upper portion of the tab 54 on the outwardly facing side 48 of the right blade. As the tab 54 is slid into the slot 22 on the hardhat 12, the wedge and stop 56 increase the press fit between the slot 22 and the tab 54 and prevent the over-insertion of the tab 54 into the slot 22. To further increase the retention of the tab 54 in the hardhat slot, one or more retaining ridges 58 may be positioned on the hardhat facing side 50 of the right blade 31 (FIGS. 6, 8, 11, 12, 16 and 19). The retaining ridges 58 may vary in height, width and position to suit the particular hardhats or accessories that are intended for use with the hardhat accessory interchange system 10.

Referring now to FIGS. 5-18, each of the blades 30, 31 includes a cylindrical housing 52 having an exterior surface 53. The tab 54 extends downwardly from the cylindrical housing 52. The cylindrical housing 52 includes an upper portion 92 and a lower portion 94 (FIGS. 5, 11-16), the lower portion being proximate to the tab 54. A central bore 60 (FIGS. 5, 12-14 and 16) extends through the cylindrical housing 52 from the outwardly facing side 48 through the hardhat facing side 50. A circular recess 62 is formed in the outwardly facing side 48 of the cylindrical housing 52, forming a circular wall 63. A plurality of teeth 64 (FIGS. 5, 13, 14 and 18) are formed in the wall 63 along the edge of a recess 62.

Figure 10:
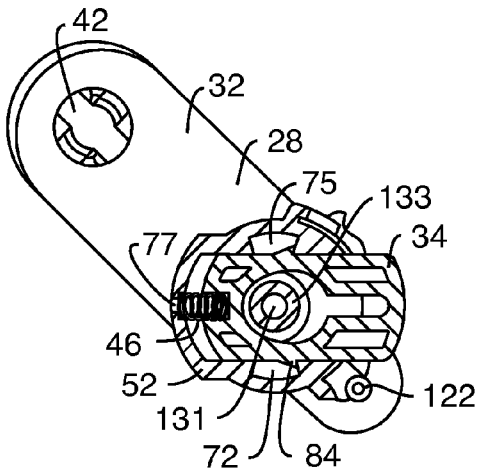
FIG. 10 is a cross-sectional view of the hardhat accessory interchange system depicted in FIG. 9 taken along line A-A.

FIGS. 8, 10, 12 and 15 depict the cavity 75 that is formed in the cylindrical housing 52. The cavity 75 is connected to a first aperture 76 and a second aperture 77 (FIGS. 8, 14 and 15), the first and second apertures extending through the exterior surface 53 on opposite sides of the cylindrical housing 52. The cavity 75 may include at least one dovetail indentation 72 and, in preferred embodiments, two dovetail indentations 72 (FIG. 10).

Figure 13:
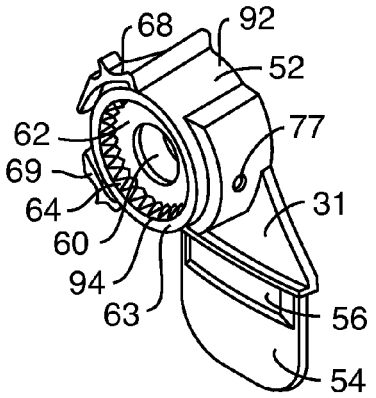
FIG. 13 is a perspective view of an embodiment of the right blade.

As shown in the embodiment depicted in FIGS. 13, 14 and 16 first and second spring arms 68 and 69, respectively are positioned on the exterior surface 53 of the cylindrical housing 52. Each spring arm 68, 69 includes a fixed end 98, 99 and a free end 96, 97. An indentation 70, 71 is positioned between the fixed end and the free end of the spring arms 68 and 69. The first spring arm 68 is positioned proximate to the upper portion 92 of the cylindrical housing 52 and the second spring arm is positioned proximate to the lower portion 94 of the cylindrical housing 52 (FIGS. 13, 14 and 16). The spring arms 68, 69 are preferably positioned on the cylindrical housing 52 so that their free ends 96, 97 are the nearest points of the spring arms to each other. The width of the gap between the indentations 70, 71 may be selected to meet the needs of the particular accessory. A rotation pin 122 engages the exterior surfaces of the spring arms 68, 69 and moves between the indentations 70, 71 to raise and lower the accessory between the up and down position. The degree of rotation required between the indentations is the degree of rotation required to move the accessory from the down position to the up position.

An embodiment of the knob attachment mechanism 40, shown in FIGS. 31-34 is also included in each hardhat accessory assembly 26, 28. Each knob attachment mechanism 40 includes a post 130 having a central portion 133, an upper portion 132, a lower portion 134 and an end 148. The central portion 133 has a diameter that is smaller than the diameters of the upper portion 132 and the lower portion 134. The knob attachment mechanism 40 further includes a threaded fastener 136 having a hex head 146. A disk 138 is positioned between the post 130 and the threaded fastener 136. The disk 138 includes an upper surface 142, a lower surface 143, a periphery 140 and grooves 150 disposed on the periphery 140 of the disk 138. The lower portion 134 of the post 130 is positioned adjacent to the upper surface 142 of the disk 138 and the hex head 146 of the threaded fastener 136 is positioned adjacent to the lower surface 143 of the disk 138.

Figure 5:
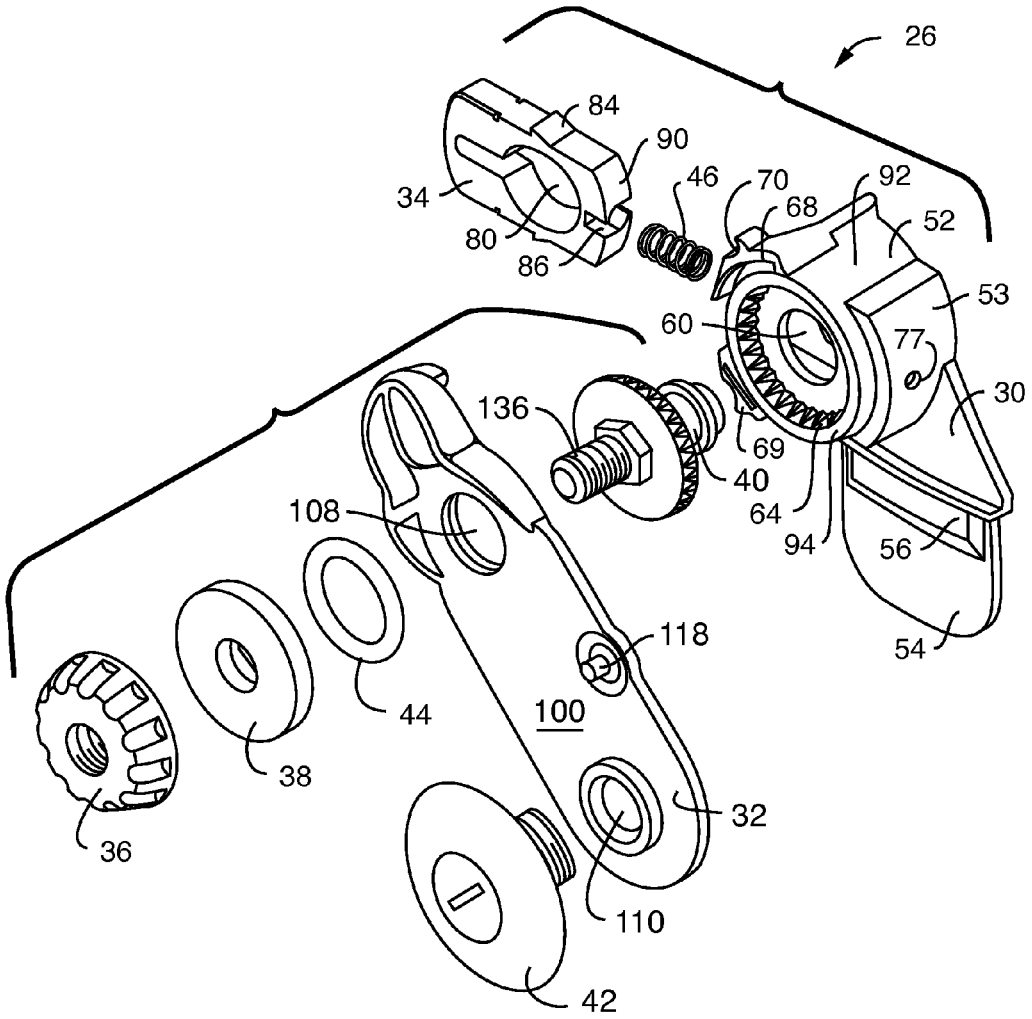
FIG. 5 is an exploded view of the right side of an embodiment of the hardhat accessory interchange system of the present invention.
Figure 6:
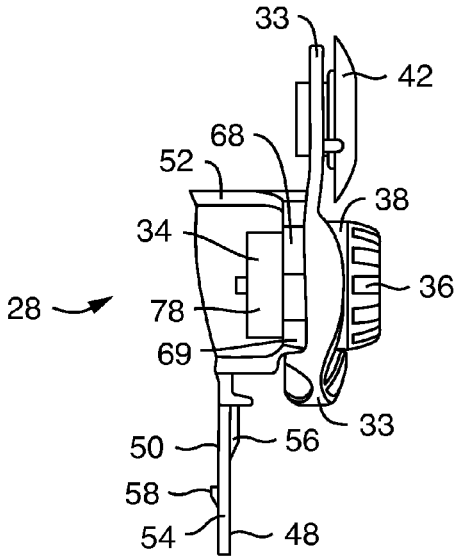
FIG. 6 is a back side view of the hardhat accessory interchange system depicted in FIG. 3.
Figure 7:
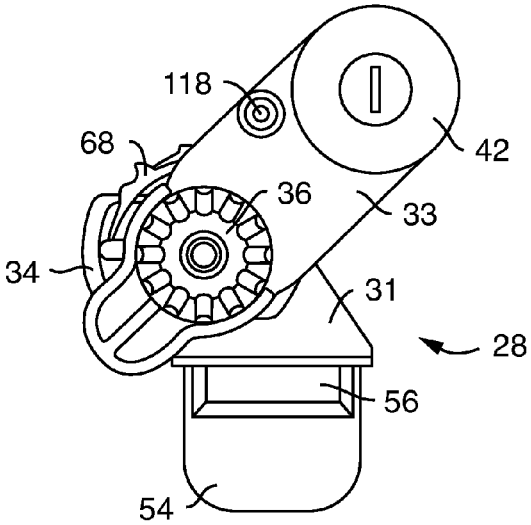
FIG. 7 is a side view of the hardhat accessory interchange system depicted in FIG. 3.
Figure 8:
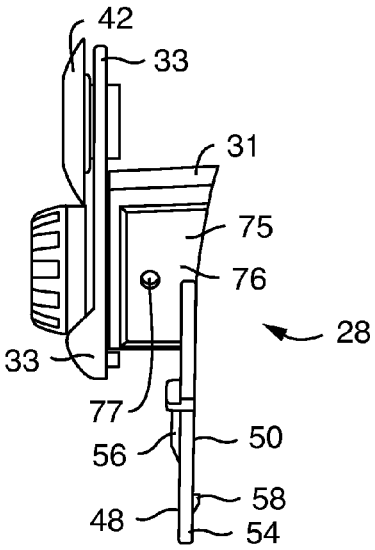
FIG. 8 is a front side view of the hardhat accessory interchange system depicted in FIG. 3.
Figure 9:
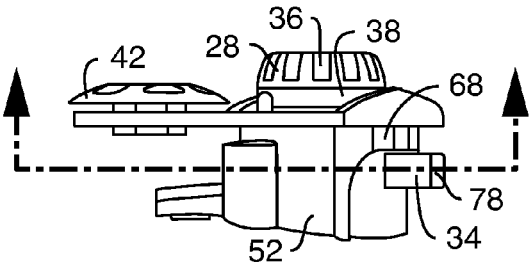
FIG. 9 is a top view of the hardhat accessory interchange system depicted in FIG. 3.

Both the left and right hardhat accessory interchange assemblies 26 and 28 include button 34 that is inserted into either the left or right blade 30, 31 through the first aperture 76 into the cavity 75 of the cylindrical housing 52 (FIGS. 4-6 and 8-12). In the embodiment depicted in FIGS. 20-24, each button 34 includes a pressing surface 78 positioned on an end of the button 34 which extends outwardly beyond the exterior surface of the cylindrical housing 52. The button 34 may include one or more cavities 88 formed in one or both sides of the button 34 to increase the flexibility of the button 34. Each button 34 includes a central opening 80 which, when the button 34 is inserted and retained in position in the cavity 75, is at least partially aligned with the central bore 60 of the cylindrical housing 52. As shown in FIG. 23, the central opening 80 of the button 34 includes a ramp 82 which engages the knob attachment mechanism 40 (FIG. 5).

As shown in FIGS. 20, 21 and 23, a spring retention channel 86 is positioned at the forward end 90 of each button 34. The spring retention channel 86 is aligned with the second aperture 77 in the blade when the button 34 is assembled in the left and right hardhat accessory interchange assemblies 26 and 28. A spring 46 is positioned within the spring retention channel 86 (FIG. 10) and biases the button 34 out of the cavity 75. The button 34 includes a pair of angular stops 84, each stop 84 formed on one side of the button 34. As shown in FIG. 10, when the button 34 is pressed into the cavity 75 overcoming the force exerted by the spring 46, the button 34 flexes and the stops 84 engage the dovetail indentations 72 that are formed in the cavity 75. The button 34 may be retained within cavity 75 by the stops 84.

Figure 12:
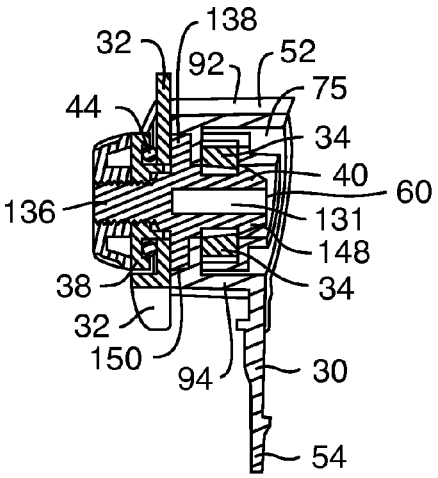
FIG. 12 is a cross-sectional view of the hardhat accessory interchange system depicted in FIG. 11 taken along line B-B.

As shown in FIGS. 5, 10 and 12 the portion of the accessory interchange assembly which is attached to the accessory includes the knob attachment mechanism 40, latch 32, knob 36 and keeper 42. This portion of the assembly is bracketed in FIG. 5. The accessory is positioned between the latch 32 and keeper 42 and the keeper 42 is secured to the latch 32. The keeper can be attached in different manners, but as shown in FIG. 5 can be threaded into the threaded opening 110 of the latch 32. The threaded fastener 136 of the knob attachment mechanism 40 is inserted through the aperture 108 in the latch 32. The knob 36 may be threaded onto the threaded fastener 136. In some embodiments, the washer 38 and o-ring 44 may be utilized.

The portion of the accessory interchange assembly which is attached to the hardhat is shown in FIG. 5 and includes the right (or left) blade, the button 34 and spring 46.

The accessory portion of the accessory interchange assembly (which includes the latch, knob and knob attachment mechanism) is attached to the accessory and moved into position to engage the hardhat portion of the accessory interchange assembly (which includes the blade, spring and button) and which is attached to the hardhat, the end 148 of the knob attachment mechanism is inserted into the central bore 60 of the left or right blade 30, 31. The upper portion 132 of post 130 engages the ramp 82, sliding the button 34 inward and permitting the end of post 132 to slide past the button 34 so that the ramp 82 engages the central portion 133 of post 130. In this manner, ramp 82 retains the end of post 130 in the cavity until the button is pushed inwardly to release the knob attachment mechanism 40. With reference to FIGS. 10 and 12, the central portion 133 of the post is seen in cross-section. In selected embodiments the post may include an aperture 131 extending at least partially through the length of the post 130.

Figure 25:
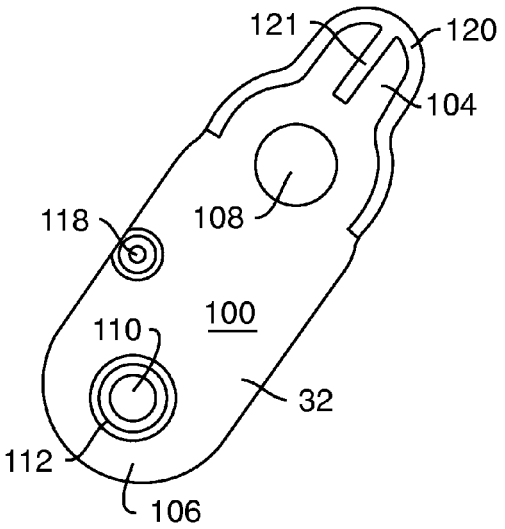
FIG. 25 is a view of an embodiment of the outward facing side of the left latch.
Figure 26:
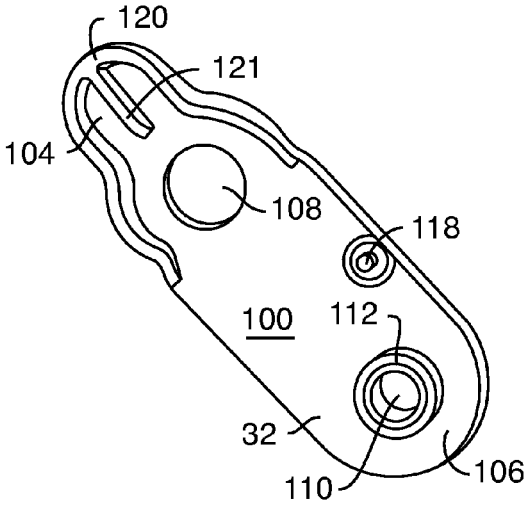
FIG. 26 is a view of an embodiment of the outward facing side of the right latch.

The left and right hardhat accessory assemblies 26, 28 also include a left latch 32 and a right latch 33, respectively, each latch including a hardhat facing side 102 and an outward facing side 100 and a first end 104 and a second end 106. FIGS. 25 and 26 depict the outward facing sides of the left and right latches, respectively.

Figure 27:
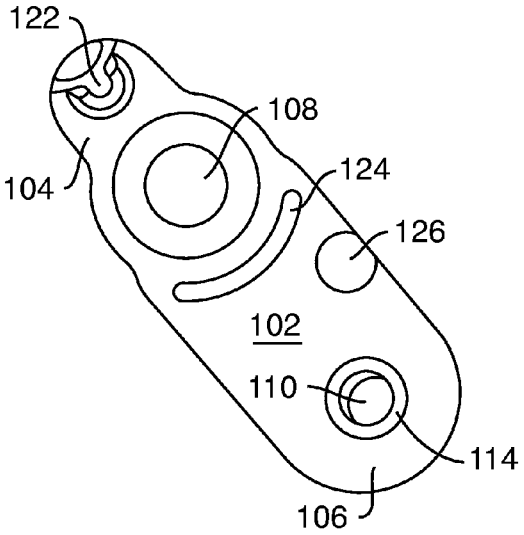
FIG. 27 is a view of an embodiment of the inward facing side of the left latch.
Figure 28:
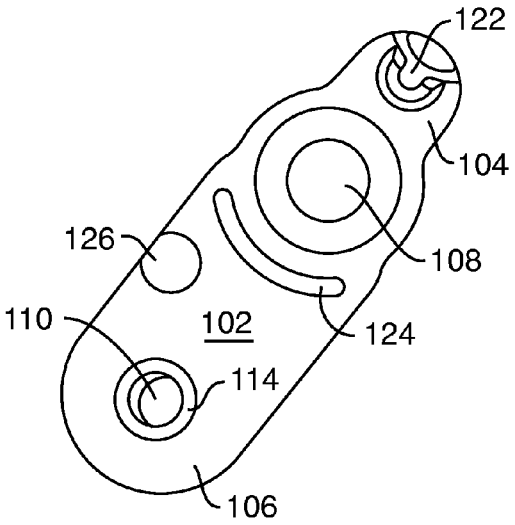
FIG. 28 is a view of an embodiment of the inward facing side of the right latch.
Figure 29:
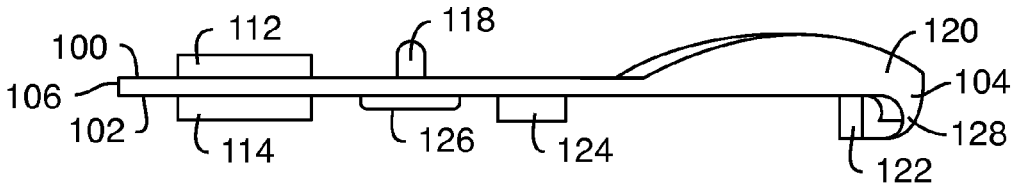
FIG. 29 is a side view of an embodiment of the left latch.
Figure 30:
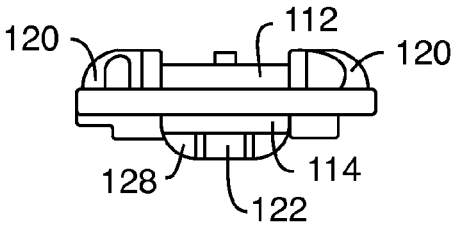
FIG. 30 is an end view of the left latch depicted in FIG. 29.
Figure 31:
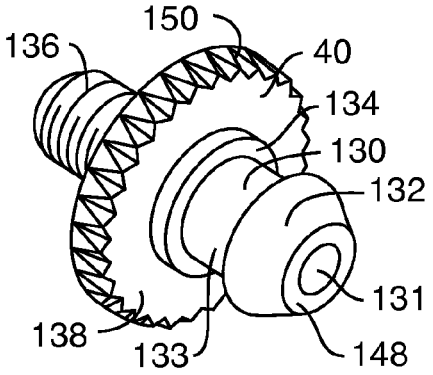
FIG. 31 is a perspective view of an embodiment of the knob attachment mechanism.
Figure 32:
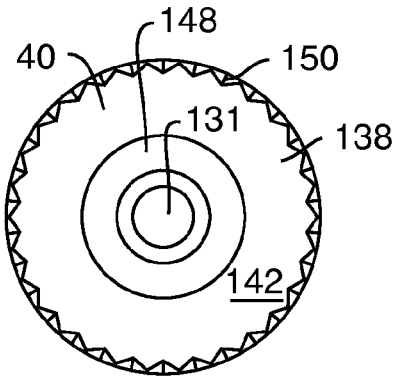
FIG. 32 is a top view of the knob attachment mechanism depicted in FIG. 31.
Figure 33:
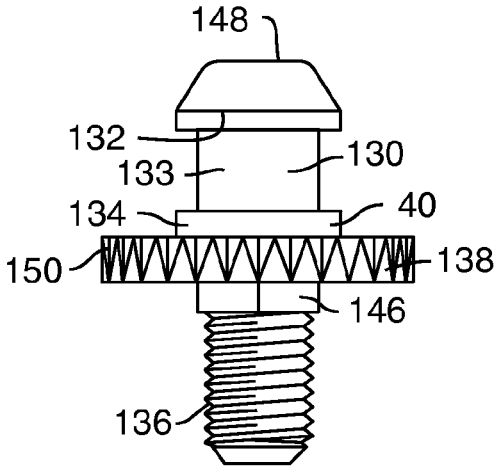
FIG. 33 is a side view of the knob attachment mechanism depicted in FIG. 31.
Figure 34:
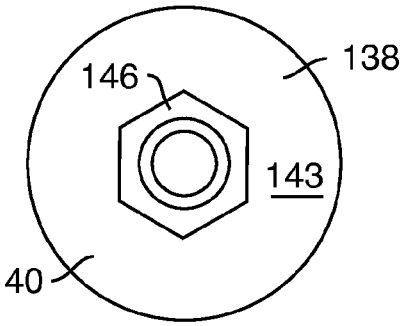
FIG. 34 is a bottom view of the knob attachment mechanism depicted in FIG. 31.

FIGS. 27 and 28 depict the hardhat facing sides of the left and right latches, respectively.

Figure 11:
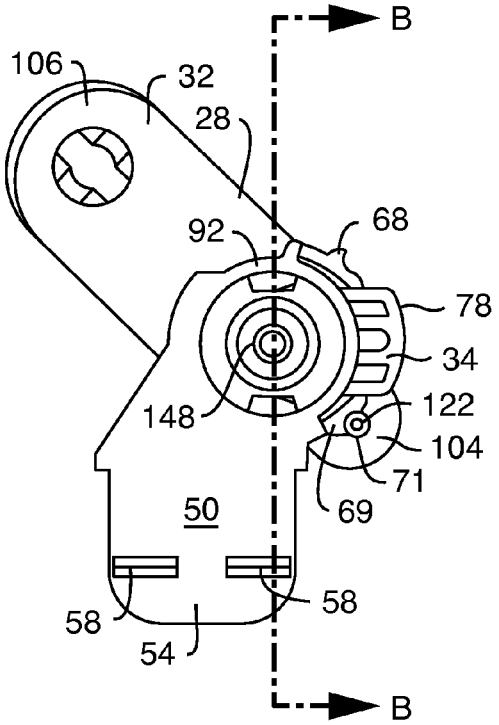
FIG. 11 is a view of the hardhat accessory interchange system showing the side that is positioned adjacent to the hardhat that is depicted in FIG. 3.

A rotation pin 122, as seen in FIGS. 27-30, is positioned on the hardhat facing side 102 of each latch 32, 33. The rotation pin 122 is positioned proximate to the first end 104 of each latch 32, 33. An arcuate rotation support rail 124 (FIGS. 27-29) may be positioned on the hard hat facing side 102 of each latch 32, 33. In selected embodiments and as shown in FIGS. 10 and 11, the rotation pin 122 on the hardhat facing side of the latches engages the spring arms 68, 69 and is movable between the indentations of the spring arms. In this manner, a user may move the accessory between a down position and an up position via a quick motion of their head. In the left and right hardhat accessory assemblies 26, 28 the rotation pin 122 moves along the first and second spring arms 68, 69. The rotation pin 122 engages the indentation 70 on spring arm 68 when the accessory is in the lowered position. As the accessory is moved into its raised position the rotation pin 122 slides along the first and second spring arms 68, 69 and comes to rest in the indentation 71 on spring arm 69.

On the outward facing side 100 of each latch 32, 33, an accessory position adjustment pin 118 is disposed. The accessory position adjustment pin 118 may be positioned in various places on the latch and is preferably positioned close to an edge of the latch. An aperture 108 is formed in each latch 32, 33, and is preferably positioned between the rotation pin 122 and the rotation support rail 124. The dimensions of the support rail 124, rotation pin 122 and accessory position adjustment pin 118 may vary depending upon the configuration of other elements of the hardhat accessory assembly. A threaded opening 110 is positioned proximate to the second end of each latch 32, 33.

Figure 35:
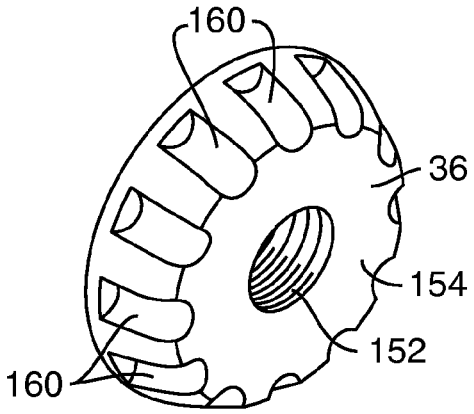
FIG. 35 is a perspective view of an embodiment of a knob useful in the present invention.
Figure 36:
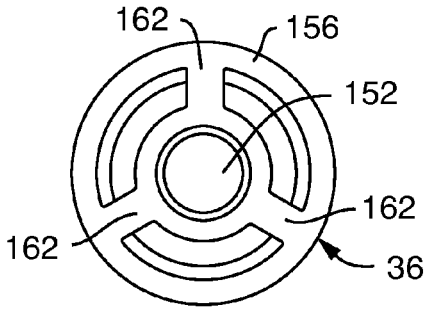
FIG. 36 is a bottom view of the knob depicted in FIG. 35.
Figure 37:
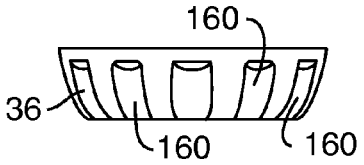
FIG. 37 is a side view of the knob depicted in FIG. 35.

The knob 36 may be variously formed but may, in certain embodiments, include an upper surface 154, a lower surface 156, and a threaded opening 152 that extends through the knob 36 from the upper surface 154 through the lower surface 156. The exterior circumferential surface 158 of the knob 36 may include a gripping feature such as gripping feature 160. The threaded fastener 136 of the knob attachment mechanism 40 may be adapted to engage the threaded opening 152 of the knob 36. An exterior circumferential surface 158 of the knob 36 may include a gripping feature 160. The gripping feature can be variously configured, but as shown in FIGS. 35 and 37 is a series of indentations.

The threaded fastener 136 of the knob attachment mechanism 40 engages the aperture 108 in the left or right latch 32, 33 so that the lower surface 143 of the disk 138 is adjacent to the hard hat facing side 102 of the left or right latch. The central opening 170 of the washer 38 may be threaded onto the threaded fastener 136 so that the lower surface 168 of the washer 38 is adjacent to the outward facing side 100 of the left or right latch. In such a configuration, the knob 36 is then threaded onto the threaded fastener 136 thereby securing the knob and washer to the outward facing side 100 of the left or right latch and securing the disk 138 and post 130 to the hard hat facing side 102 of the left or right latch. The hex head 146 (FIG. 33) engages the hexagonal opening 172 in the washer 38 through the aperture 108 so that, when the knob 36 is tightened sufficiently, rotating the knob 36 causes the knob, latch and knob attachment mechanism to rotate as a single unit. In some embodiments it may be preferable for the latch to be permitted to rotate with respect to the knob 36 and knob attachment mechanism 40. This permits the rotation pin 122 to move between the indentations 70, 71 thus moving the accessory between the up and down positions.

Referring to FIG. 5, the button 34 and spring 46 are assembled into the right blade 31. An embodiment of the knob attachment mechanism 40 (not shown) is positioned on the hardhat facing side 102 of the left latch 32, the threaded fastener 136 of the knob attachment mechanism 40 extending through the opening 108. The washer 38, o-ring 44 and knob 36 are threaded onto the threaded fastener 136 and tightened.

Each keeper 42 is adapted to secure the second end 106 of either the right latch 33 or the left latch 32 to the accessory 16, the keeper 42 having a head 178 having a slot 179 disposed therein. A threaded post 180 extends downwardly from the head 178 and is adapted to engage the threaded opening 110 in the left or right latch so that the accessory may be secured between the hard hat facing side 102 of the right or left latch and the keeper 42.

Being thus assembled, the left latch is attached to an accessory such as a face shield 16 by positioning the outward facing side 100 of the left latch on the interior of the face shield proximate to an opening (not shown) in the face shield. The threaded post 180 of the keeper 42 is positioned on the exterior of the face shield and threaded through the opening. The threaded opening 110 of the left latch is configured to receive the threaded post 180 of the keeper 42. The accessory position pin 118 is positioned within one of the adjustment holes 19 on the face shield 16. If the keeper 42 is tightened sufficiently, the left latch is attached to the accessory in a fixed position. The angle of attachment between the latch and the face shield may be adjusted by aligning the accessory position adjustment pin 118 to different adjustment hole 19.

The tab 54 of the left blade 30 is inserted within the slot 22 of the hardhat 12 until the top of the slot 22 engages the wedge and stop 56 on the tab 54. As shown in FIG. 12, the top 148 of the post 130 is inserted into the central bore 60 of the blade. As the post 130 moves into the central bore 60, the ramp 82 on the button 34 contacts the post 130, forcing the button 34 to move forward in the cavity 75. As soon as the upper portion 132 of the post 130 passes the ramp 82, the ramp 82 encounters the narrow portion 133 of the post 130. The spring 46 then moves the button 34 backward in the cavity 75, causing the ramp 82 to contact the narrow portion 133 of the post 130 and lock the post 130 into the central bore. This also causes the grooves 150 in the periphery 140 of the disk 138 to engage the teeth 64 on the left blade 30. Hence, the left blade 30 and knob attachment mechanism are held in a fixed position relative to each other. When the hardhat accessory interchange system 10 is installed in a hardhat, the accessory can be changed by pressing the buttons 34 into the blades 30 and 31, causing the posts 130 to be released and the accessory removed from the hardhat 12. Another accessory which includes the left and right assemblies 26, 28 may then be put onto the hardhat.

Figure 38:
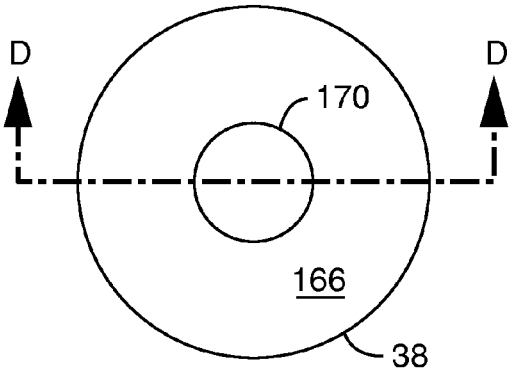
FIG. 38 is a top view of an embodiment of a washer useful in the present invention.
Figure 39:
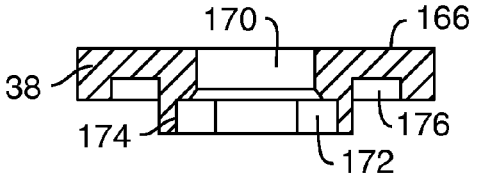
FIG. 39 is a cross-sectional view of the washer depicted in FIG. 38 taken along lines D-D.
Figure 40:
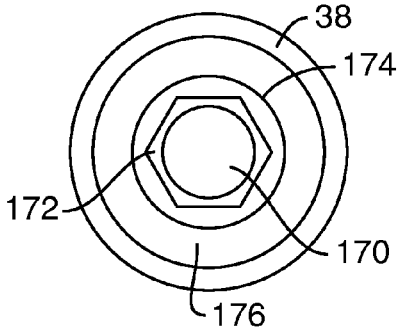
FIG. 40 is a bottom view of the washer depicted in FIG. 38.
Figure 41:
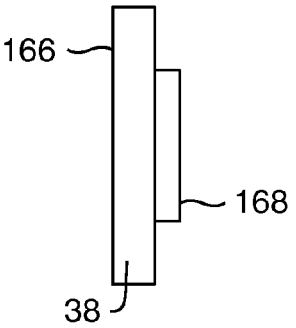
FIG. 41 is a side view of the washer depicted in FIG. 38.
Figure 42:
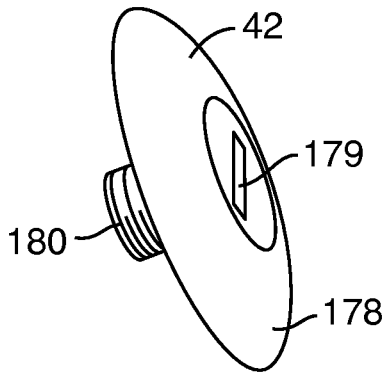
FIG. 42 is a perspective view of an embodiment of a keeper useful in the present invention.
Figure 43:
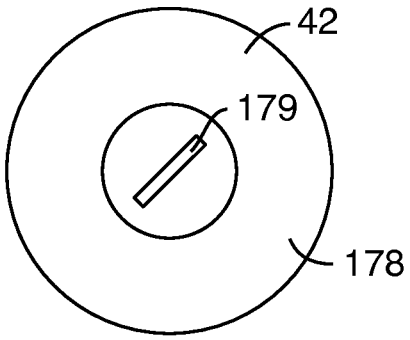
FIG. 43 is a top view of the keeper depicted in FIG. 42.
Figure 44:
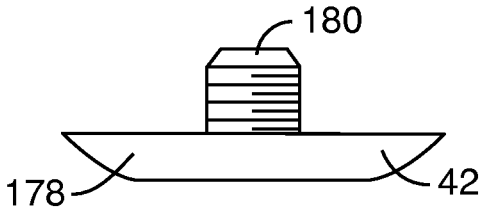
FIG. 44 is a side view of the keeper depicted in FIG. 42.

A washer 38 may be of use in the assembly of the present invention. In such embodiments, the washer 38 may be used in conjunction with a sealing o-ring as depicted in FIGS. 5 and 38. An exemplary washer may have an upper washer surface 166 and a lower washer surface 168 and a central opening 170 extending from the upper washer surface 166 through the lower washer surface 168. Proximate to the lower washer surface 168, the central opening 170 may form a hexagonal opening 172 that is adapted to engage the hex head 146 of the knob attachment mechanism 40. the lower surface 168 of the washer 38 may be configured to be positioned adjacent to the outward facing side 100 of the left latch 32 or right latch 33 proximate to the aperture 108. The washer 38 may further include a circular channel 176 within which may be positioned a sealing o-ring 44.

FIG. 47 illustrates another embodiment of the present invention wherein some of the components, such as the latches 32, 33 may be formed as an integral part of the face shield assembly 16 or other accessory. As shown therein, that particular embodiment eliminates the need for the keeper 42 and accessory adjustment pin 118.

It should be appreciated by those skilled in the art that various modifications and variations may be made to features of the dispenser described herein, particularly to the mechanical and control circuitry aspects of the dispenser, without departing from the scope and spirit of the invention. It is intended that the invention include all such variations.

What is claimed is:

1. A hardhat accessory interchange system adapted to attach an accessory to a hardhat having a left slot and a right slot, the hardhat accessory interchange system comprising:

two accessory interchange assemblies, each assembly adapted to engage at least one slot in the hardhat, each assembly comprising a blade adapted to engage at least one slot in the hardhat, the blade comprising a cylindrical housing having a central bore extending through the cylindrical housing, a circular recess formed in an outwardly facing side of the cylindrical housing, a cavity formed in the cylindrical housing, the cavity being connected to a first aperture and a second aperture in the cylindrical housing;

a tab extending downwardly from the cylindrical housing, the tab configured to fit within at least one slot in the hardhat;

first and second spring arms positioned on the cylindrical housing, each spring arm including a fixed end, a free end and an indentation disposed between the fixed end and the free end, the first spring arm being positioned proximate to an upper portion of the cylindrical housing and the second spring arm being positioned proximate to a lower portion of the cylindrical housing;

a button inserted into the blade through the first aperture into the cavity of the cylindrical housing, the button having a central opening which at least partially aligns with the central bore of the cylindrical housing, a spring retention channel positioned at the forward end of each button, a pressing surface positioned on an end of the button extending outwardly beyond the exterior surface of the cylindrical housing, at least one angled stop extending from the button and adapted to engage a dovetail indentation formed within the cylindrical housing, the angled stop of the button engaging the dovetail indentation of the blade to retain the button within the cylindrical housing;

a spring positioned within the spring retention channel of the button, the pressing surface of the button being positioned exteriorly of the blade;

a latch comprising a hardhat facing side, an outward facing side, a first end and a second end, a rotation pin positioned on the hardhat facing side of the latch proximate to the first end of the latch, an arcuate rotation support rail positioned on the hard hat facing side of the latch, an accessory position adjustment pin positioned on the outward facing side of the latch, an aperture positioned proximate to the rotation pin and the rotation support rail, and a threaded opening positioned proximate to the second end;

a knob attachment mechanism comprising a post having a central portion, an upper portion and a lower portion, wherein the central portion has a diameter that is smaller than the diameters of the upper portion and the lower portion, a threaded fastener having a hex head, a disk having an upper surface, a lower surface, a periphery and grooves disposed on the periphery of the disk, wherein the lower portion of the post is positioned adjacent to the upper surface of the disk and the hex head of the threaded fastener is positioned adjacent to the lower surface of the disk;

a knob comprising an upper surface and a lower surface, a threaded opening extending through the knob from the upper surface through the lower surface, and an exterior circumferential surface having a gripping feature;

wherein the threaded fastener of the knob attachment mechanism is adapted to engage the threaded opening of the knob; wherein the threaded fastener of the knob attachment mechanism engages the aperture in the left or right latch so that the lower surface of the disk is adjacent to the hard hat facing side of the left or right latch, and wherein the knob is threaded onto the threaded fastener thereby securing the knob to the outward facing side of the left or right latch and securing the disk and post to the hard hat facing side of the left or right latch; and a keeper adapted to secure the second end of the latch to the accessory, the keeper having a head having a slot disposed therein, and a threaded post extending downwardly from the head and adapted to engage the threaded opening in the latch so that the accessory is positioned between the hard hat facing side of the latch and the keeper.

2. The system of claim 1, the tab further comprising a wedge on an outward facing side of the tab, the wedge configured so that as the tab is inserted into the slot of the hardhat, the wedge increases the press-fit between the tab and the opening of the hardhat, the wedge further including a stop which prevents the tab from being inserted too far into the slot.

3. The system of claim 1, further including a washer having an upper washer surface and a lower washer surface, a central opening extending from the upper washer surface through the lower washer surface, the central opening proximate to the lower washer surface forming a hexagonal opening adapted to engage the hex head of the knob attachment mechanism, the lower surface of the washer adapted to be positioned adjacent to the outward facing side of the latch proximate to the aperture.

4. The system of claim 3 wherein the washer further includes a circular channel within which is positioned an o-ring.

5. The system of claim 1 wherein the accessory comprises a face shield assembly.

6. The system of claim 1 wherein the accessory comprises a welding face shield.

7. The system of claim 1 wherein the knob comprises a threaded opening extending through the knob from the upper surface through the lower surface.

8. The system of claim 1 wherein the knob includes an exterior circumferential surface having a gripping feature.

* * * * *